US008844850B2

(12) United States Patent
He

(10) Patent No.: US 8,844,850 B2
(45) Date of Patent: Sep. 30, 2014

(54) DYNAMIC SELF-CLEANING DOWNHOLE DEBRIS REDUCER

(75) Inventor: Zhi Yong He, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 414 days.

(21) Appl. No.: 13/423,915

(22) Filed: Mar. 19, 2012

(65) Prior Publication Data

US 2013/0056216 A1 Mar. 7, 2013

Related U.S. Application Data

(60) Provisional application No. 61/531,903, filed on Sep. 7, 2011.

(51) Int. Cl.
*B02C 23/36* (2006.01)
*E21B 41/00* (2006.01)

(52) U.S. Cl.
CPC ..... *E21B 41/00* (2013.01)
USPC ..... 241/84.4; 241/94; 241/95; 241/262; 166/235; 166/311; 210/170.04

(58) Field of Classification Search
USPC ..... 241/262, 84.4, 94, 95; 166/227, 235, 166/311; 210/170.04
See application file for complete search history.

(56) References Cited

U.S. PATENT DOCUMENTS

| | | | |
|---|---|---|---|
| 6,276,452 | B1 | 8/2001 | Davis et al. |
| 7,497,260 | B2 | 3/2009 | Telfer |
| 2009/0283330 | A1 | 11/2009 | Lynde et al. |
| 2010/0155067 | A1 | 6/2010 | Tunget |
| 2011/0049025 | A1 | 3/2011 | Davis et al. |

*Primary Examiner* — Mark Rosenbaum
(74) *Attorney, Agent, or Firm* — Shawn Hunter

(57) ABSTRACT

A debris reducer for reducing debris within a fluid flow line having a lower screen that is secured within the flow line, the lower screen having a lower screen cage with a lower cutting portion. A debris reducer element is retained within the flow line and is moveably disposed with respect to the lower screen. The debris reducer element has an upper screen cage with an upper cutting portion. The upper and lower screen cages overlap and move the upper and lower cutting portions with respect to each other to reduce debris within fluid flowing through the flow line.

14 Claims, 11 Drawing Sheets

DYNAMIC SELF-CLEANING DOWNHOLE DEBRIS REDUCER

This application claims priority to U.S. provisional patent application Ser. No. 61/531,903 filed Sep. 7, 2011.

BACKGROUND OF THE INVENTION

1. Field of the Invention

The present invention generally relates to devices and methods for reducing the size of debris within a flow line or flow path.

2. Description of the Related Art

Debris clogs flow lines. During chemical injection operations, for example, various completion chemicals are flowed into a wellbore. Many such chemicals incorporate dissolved limestone or other powdered solids which are carried by a liquid. These chemicals have a tendency to clump and clog the flowline into the injection valve inhibiting operation.

SUMMARY OF THE INVENTION

The present invention provides devices and methods for reducing debris from within a flowpath, such as the flowline into a chemical injection valve. This results in the debris being less likely to form a clog and permits it to be more easily flowed along the flowline. In a described embodiment, a self-cleaning downhole debris reducer is incorporated into a flowline to a chemical injector that is used to inject chemicals into a wellbore. The exemplary debris reducer includes an outer housing that is incorporated into the flowline and a debris reducer element that is moveably disposed within the housing. In preferred operation, the debris reducer element is actuated by fluid flow to move axially and reciprocally within the outer housing.

According to described embodiments, the debris reducer element is axially biased by a spring toward a first position within the outer housing. Fluid flow through the outer housing will urge the debris reducer element axially downwardly within the outer housing and compress the spring. As the debris reducer element is moved downwardly, a lower portion of the debris reducer element is rotated within the outer housing with respect to an upper portion of the debris reducer element. Interruption or variation in the flow of fluid to the debris reducer will permit the spring to return the debris reducer element to its first position. The axial movement and rotation of a portion of the debris reducer element with respect to a lower screen will function to crush and reduce debris between an upper screen and an inner screen. The upper screen includes an upper screen cage with cutter portions that overlap a lower screen cage with cutter portions that is carried by the lower screen.

In operation, the debris reducer will grind and reduce debris within fluid flowing through the flowline toward the chemical injector. According to an exemplary method of operation to reduce debris, fluid is flowed into the debris reducer and urges a flow head and associated upper screen axially downwardly, compressing the spring. As fluid flows through the passages of the flow head, the spring will urge the upper screen upwardly again. Thus, fluid flow through the filter will result in the upper screen being alternately moved axially upwardly and downwardly within the outer housing. In addition, upward and downward movement of the flow head will cause the upper screen to be rotated within the outer housing. Fluid flowing through the passages in the flow head will pass downwardly into the lower screen where the axial and rotational movement of the upper screen with respect to the lower screen will crush and grind debris within the lower screen.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

Figure 1:
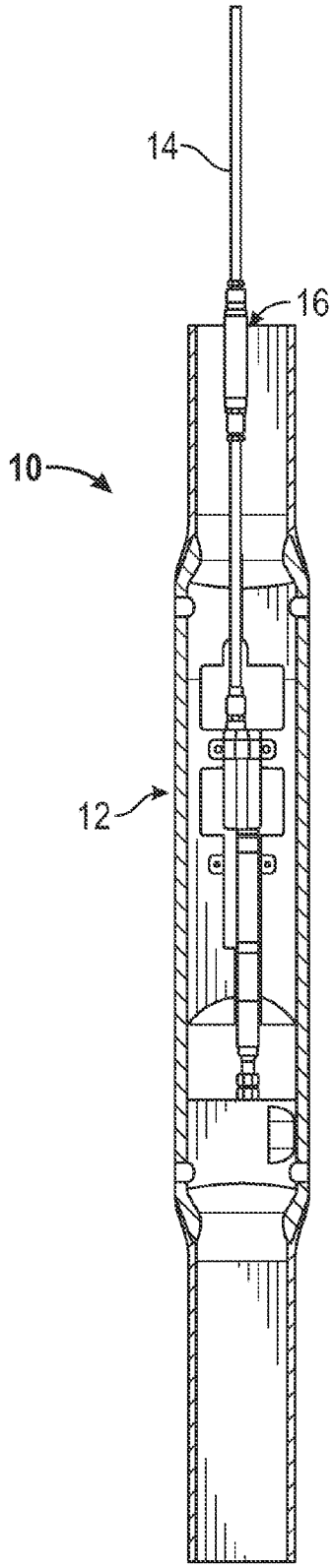
FIG. 1 is a side, cross-sectional view of an exemplary chemical injection system which incorporates a dynamic, self-cleaning debris reducer in accordance with the present invention.
Figure 2:
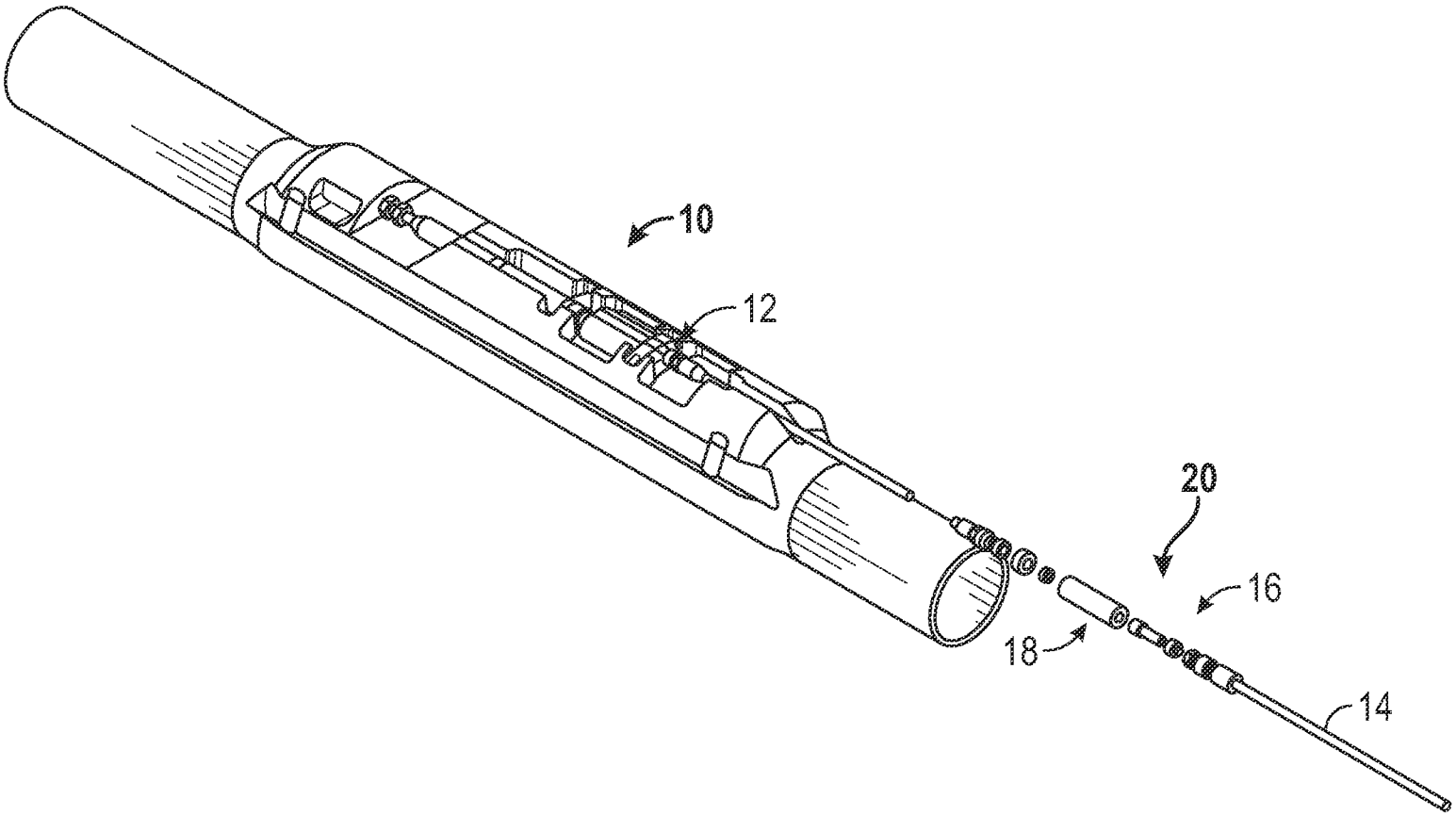
FIG. 2 is an isometric, partially exploded view of the chemical injection system of claim 1.

FIGS. 1 and 2 illustrate an exemplary chemical injection system 10 which includes an in-line chemical injector 12 of a type known in the art. Details related to chemical injection and chemical injectors are described in, for example, U.S. Pat. No. 6,663,361 entitled "Subsea Chemical Injection Pump" and issued to Kohl et al. and U.S. Pat. No. 7,234,524 entitled "Subsea Chemical Injection Unit for Additive Injection and Monitoring System for Oilfield Operations" issued to Shaw et al. Both of these patents are owned by the assignee of the present invention and which are herein incorporated by reference. Chemical flowline 14 extends from the surface of a wellbore (not shown) wherein it is typically operably associated with a supply of chemical to be injected and a fluid pump (not shown), as is known in the art.

A dynamic, self-cleaning downhole debris reducer 16 is incorporated into the flowline 14. The debris reducer 16 generally includes an outer housing 18 and a debris reducer element 20 that is retained within the outer housing 18. An exemplary debris reducer 16 is shown in greater detail in FIGS. 3-6. As can be seen with reference to FIGS. 2, 4 and 5, the outer housing 18 can be integrated into the chemical flowline 14 and includes a cylindrical body 19 that defines a central flowbore 21. Flange 23 projects radially inwardly from the body 19 into the flowbore 21.

The debris reducer element 20 of the debris reducer 16 includes a generally conical flow head 22 at the upper or upstream end of the debris reducer element 20. The flow head 22 has an enlarged diameter that approximates the interior diameter of the flowbore 21. The flow head 22 includes a plurality of axial passages 24 that are disposed radially around a central hub 26. The flow head 22 functions to absorb the force of fluid flow against the debris reducer element 20. In addition, the passages 24 permit fluid to bleed past the flow head 22. The flow head 22 is fixedly secured to a drive shaft 28 by interference fit, splining, threading or in another manner known in the art. The drive shaft 28 includes a central shaft portion 30 and a plurality of vanes 32 that project radially outwardly from a lower portion of the shaft portion 30. The vanes 32 each present a tapered lower end 34. The shaft portion 30 of the drive shaft 28 defines a hollow axial bore 36 along its length.

Figure 3:
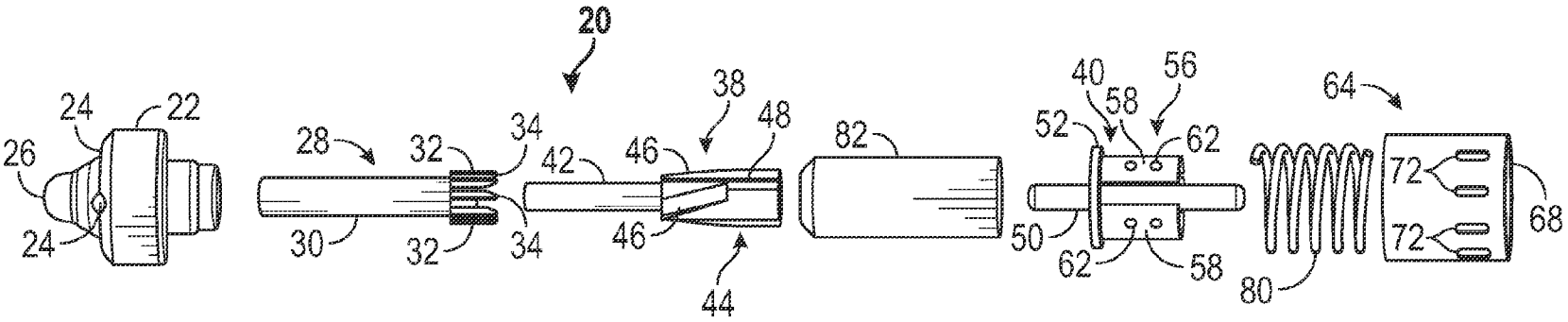
FIG. 3 is an isometric, exploded view of an exemplary dynamic self-cleaning debris reducer constructed in accordance with the present invention.
Figure 8:
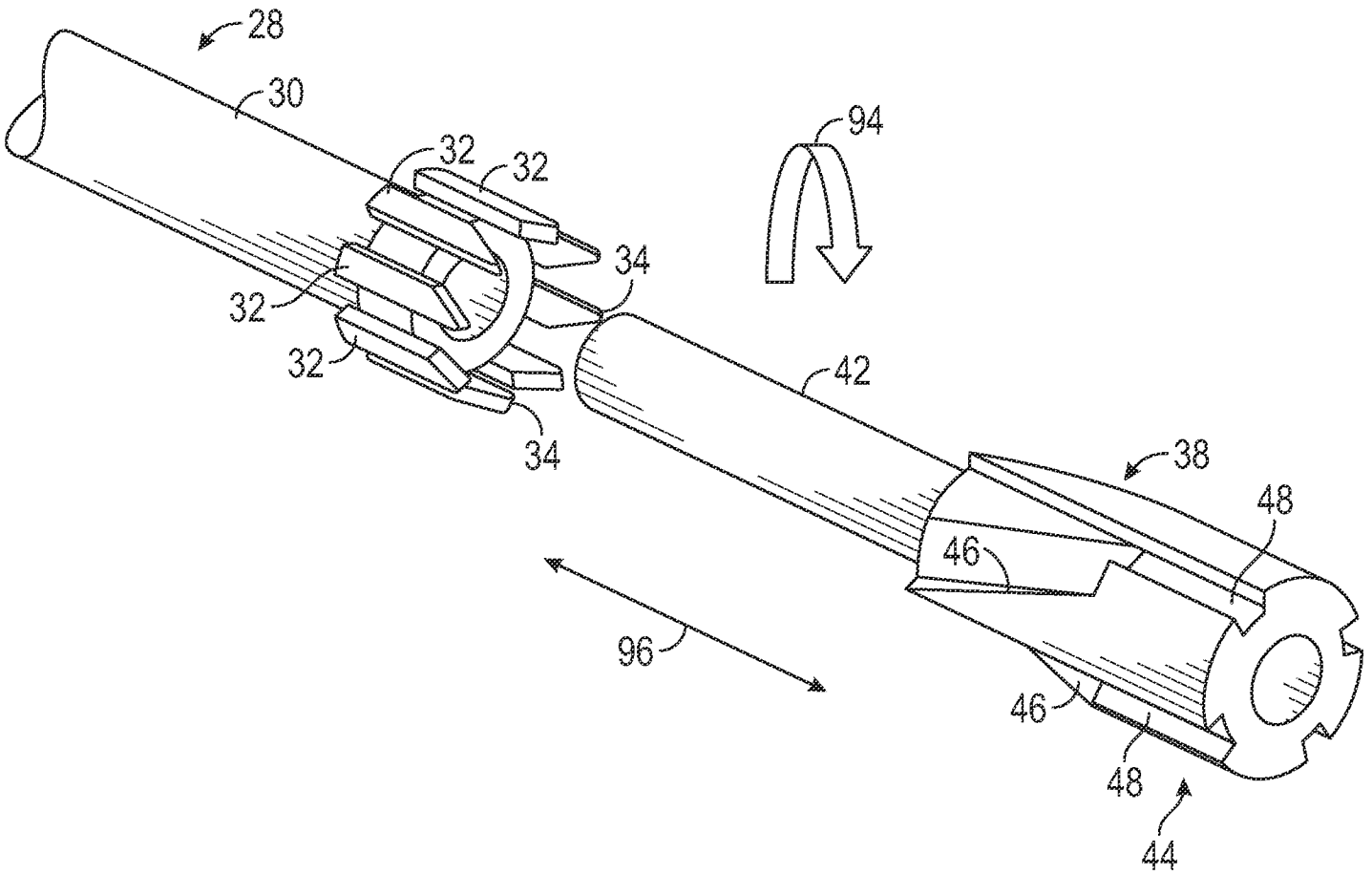
FIG. 8 is an enlarged external, isometric view of the exemplary debris reducer shown in FIGS. 3-7.

A drive seat 38 is located below the drive shaft 28 and is fixedly secured to upper screen 40 by splining, threading or the like. The drive seat 38 includes an upper shaft portion 42 and an enlarged lower portion 44. The outer radial surface of the lower portion 44 presents a plurality of angled outer guide surfaces 46 that are disposed in a spaced relation about the outer circumference of the lower portion 44. These are best seen in FIG. 3. The angled guide surfaces 46 project radially outwardly from the lower portion 44 and extend in a helical fashion around the lower portion 44. In addition, the outer radial surface of the lower portion 44 presents longitudinal grooves 48 (see FIGS. 3 and 8) that are also disposed in a spaced relation around the outer circumference of the lower portion 44.

In the depicted embodiment, the inner screen 40 includes a central shaft 50 that passes through a circular plate 52. Apertures 54 are disposed through the plate 52. An upper screen cage, generally indicated at 56, extends axially downwardly from the plate 52. In the depicted embodiment, the upper screen cage 56 is made up of a number of arcuate cage segments 58 that carry serrated radial cutting edges 60. In the depicted embodiment, there are three such cage segments 58. However, there may be more or fewer than three segments 58, as desired. A plurality of apertures 62 is disposed through each of the segments 58.

Figure 4:
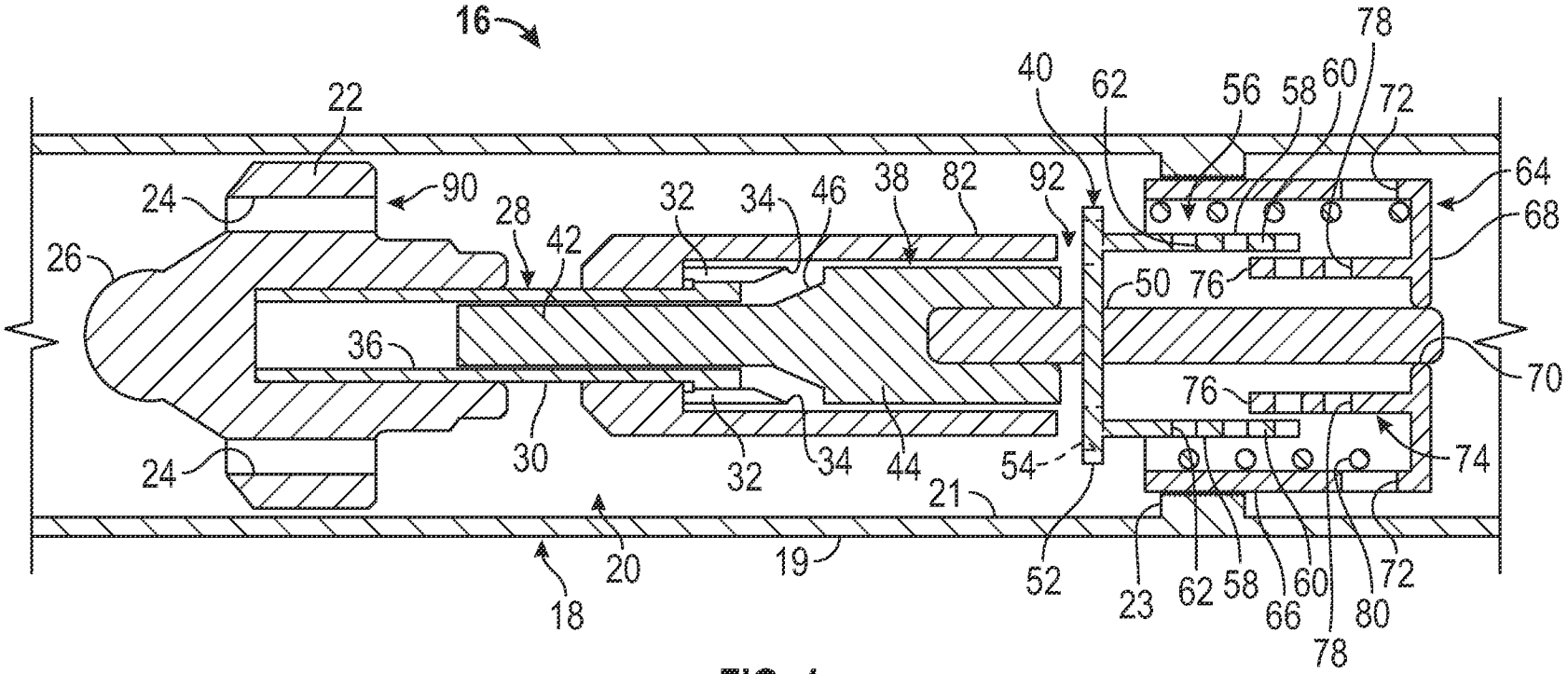
FIG. 4 is a side, cross-sectional view of the assembled debris reducer shown in FIG. 3.
Figure 5:
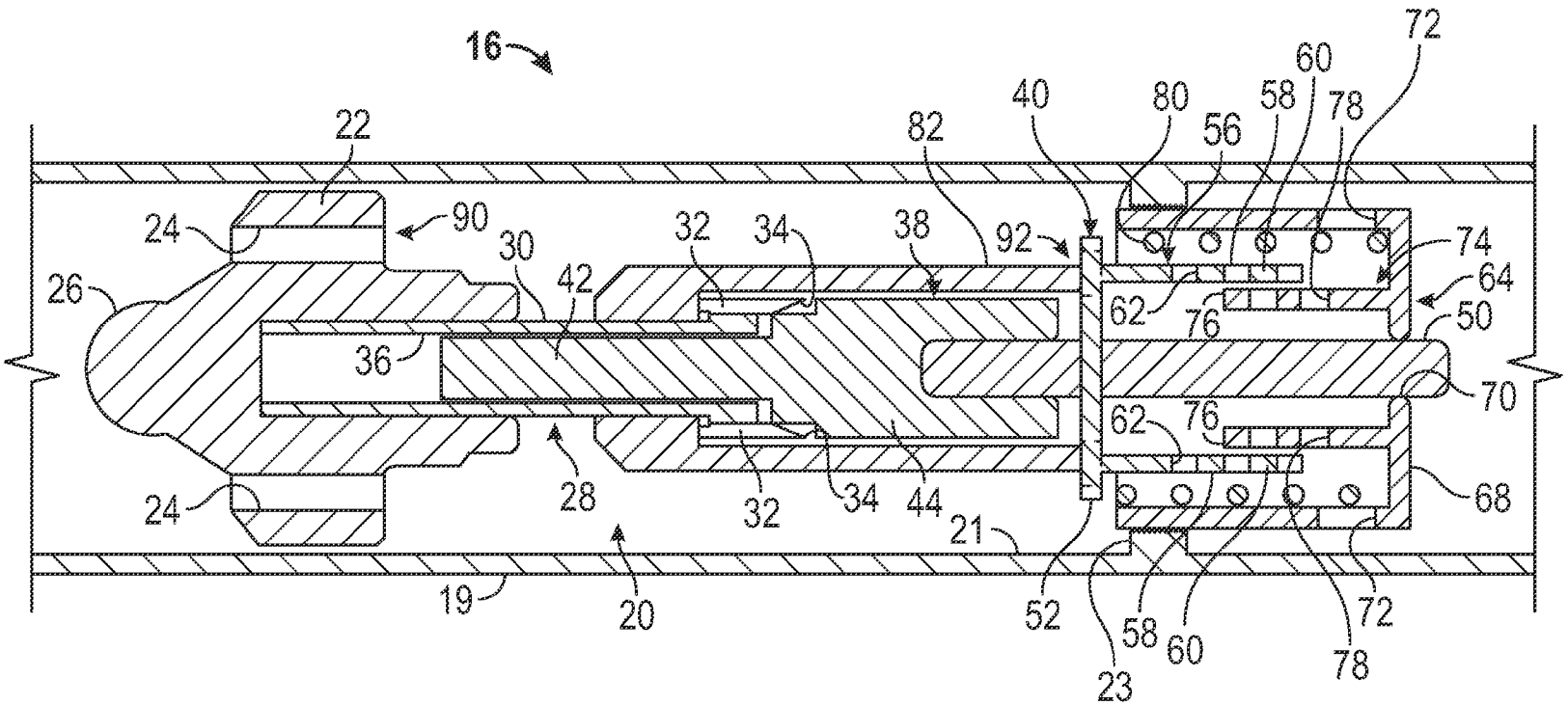
FIG. 5 is a side, cross-sectional view of the debris reducer shown in FIGS. 3 and 4, now in an actuated condition.
Figure 9:
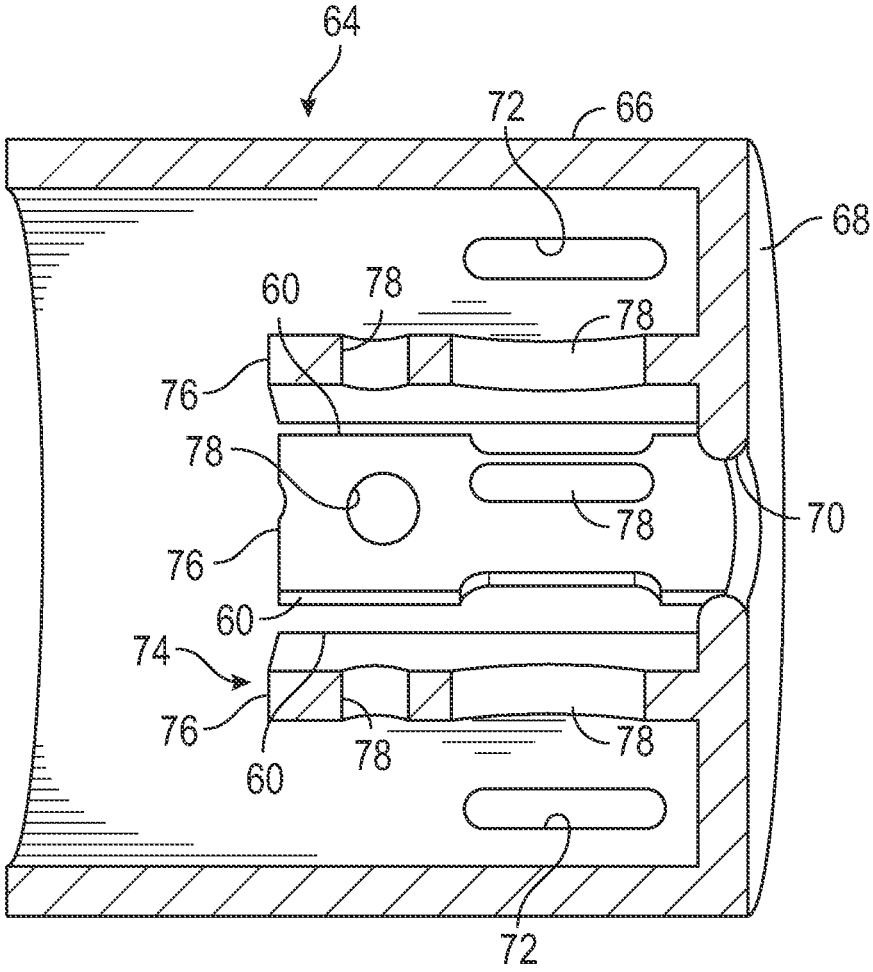
FIG. 9 is an enlarged cross-sectional view of an exemplary outer screen used with the debris reducer shown in FIGS. 3-8.

A lower screen 64 is fixed within the outer housing 18, as illustrated in FIGS. 4 and 5. The exemplary lower screen 64 is a generally cylindrical barrel 66 with a closed lower end 68. FIG. 9 illustrates portions of the lower screen 64 in greater detail. An opening 70 is formed within the lower end 68 which is shaped and sized to loosely receive the shaft 50 of the upper screen 40. Lateral fluid flow ports 72 are disposed through the barrel 66 of the lower screen 64. A lower screen cage, generally indicated at 74, is located within the barrel 66, projecting upwardly from the lower end 68. The lower screen cage 74 includes a plurality of arcuate cage segments 76 with openings 78 disposed therein. The lower screen cage 74 lies coaxially within the upper screen cage 56.

Figure 7:
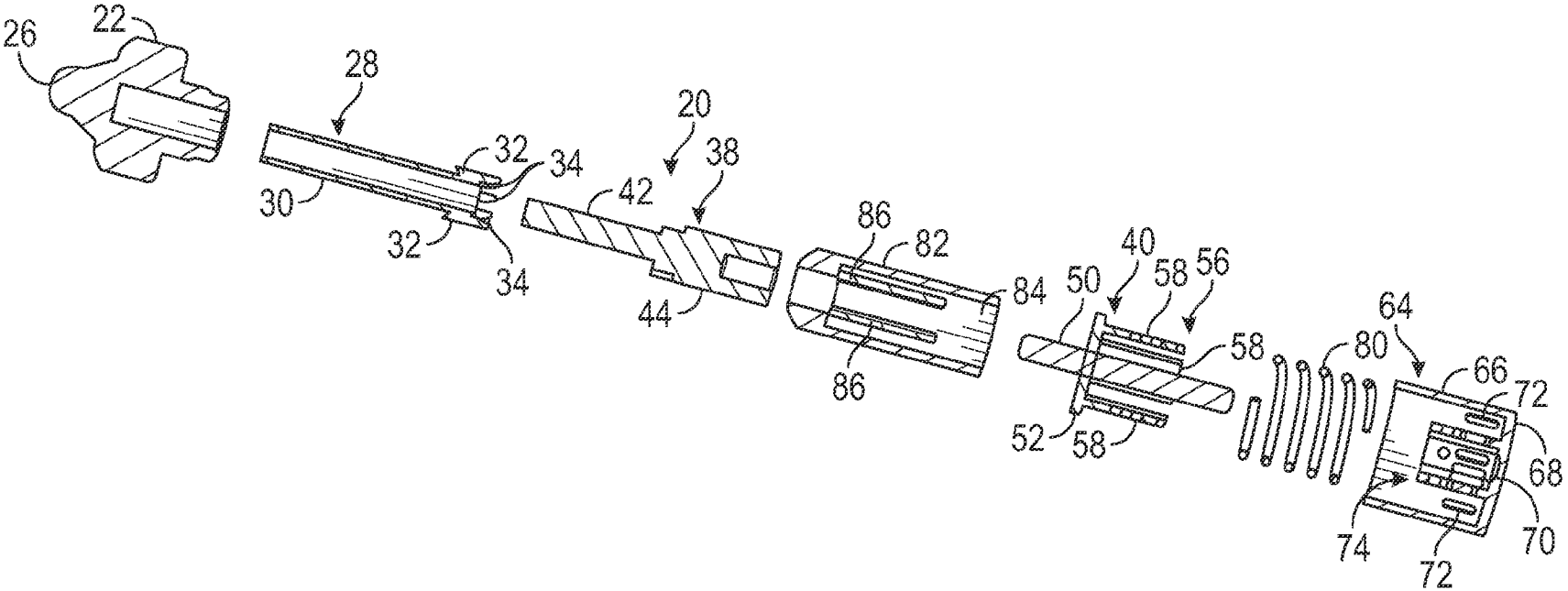
FIG. 7 is an exploded, cross-sectional view of portion of the exemplary debris reducer of FIGS. 3-6.

A compressible spring 80 is disposed within the lower screen 64 and biases the upper screen 40 axially upwardly. A generally cylindrical shroud 82 radially surrounds the drive seat 38 and the vanes 32 of the drive shaft 28. As can be seen from FIG. 7, the shroud 82 defines a central open bore 84 having longitudinal, axial grooves 86 that are shaped and sized to receive the vanes 32 of the drive shaft 28, thereby preventing the drive shaft 28 from rotating within the shroud 82.

Figure 6:
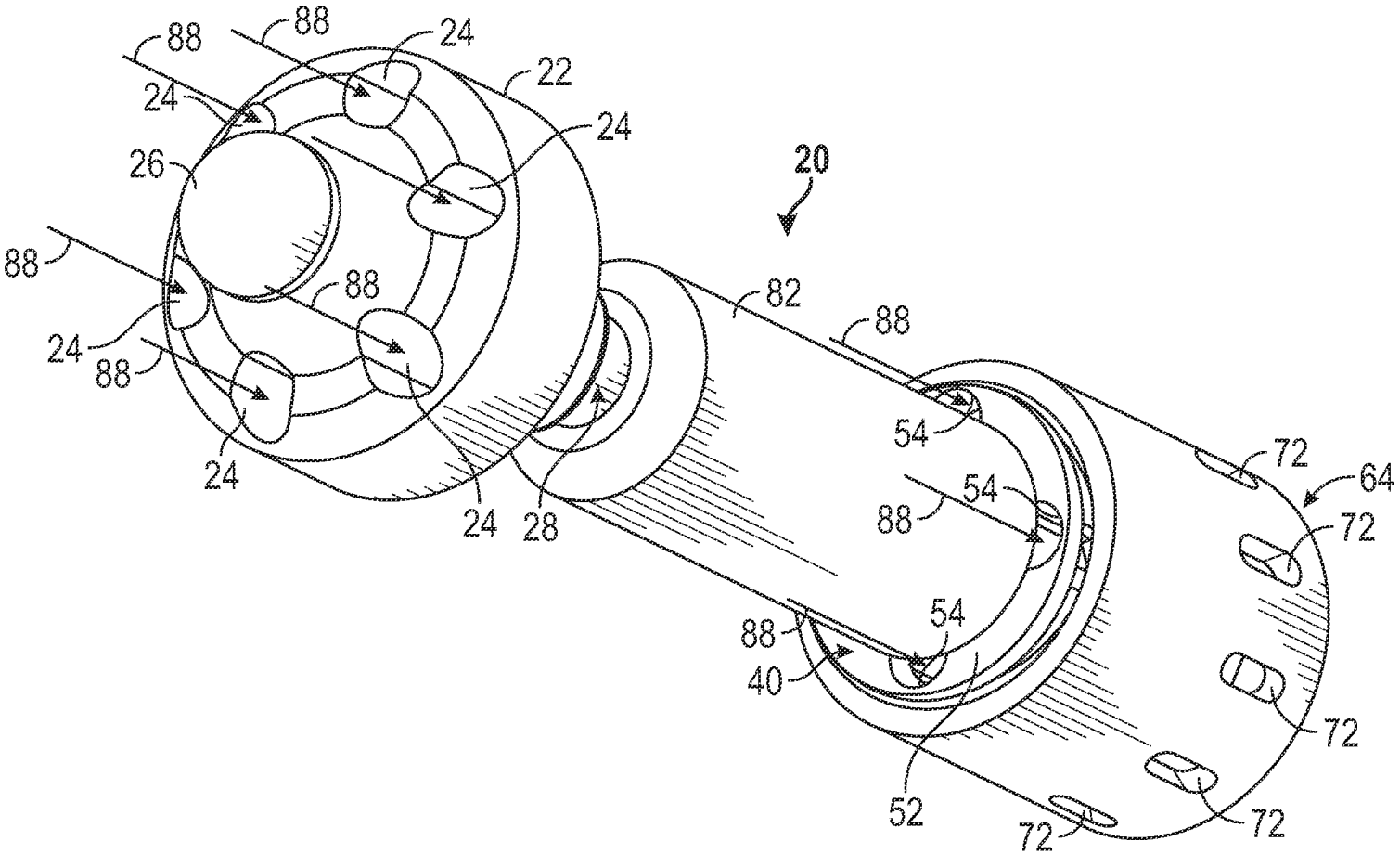
FIG. 6 is an isometric view of portions of the exemplary debris reducer shown in FIGS. 3-5 and depicting flowpaths.

When the debris reducer 16 is assembled within the chemical flowline 14 for the chemical injector 12, injection chemical fluid is flowed down through the flowline 14 from the surface. Arrows 88 in FIG. 6 illustrate the direction and flowpaths for this fluid. FIGS. 4 and 5 depict actuation of the debris reducer 16 in response to the fluid flow. FIG. 4 shows the debris reducer 16 in a first position wherein the fluid flow is not significantly compressing the spring 80. In this position, the lower ends 34 of the drive shaft vanes 32 are located above the angled guide surfaces 46 of the drive seat 38. FIG. 5 illustrates the debris reducer 16 in a second position wherein fluid flow has urged the debris reducer element 20 axially downwardly with respect to the outer screen 64, compressing the spring 80.

It should be understood that the debris reducer element 20 is made up of an upper portion 90 and a lower portion 92. The upper portion 90 includes the flow head 22 and the affixed drive shaft 28 as well as the shroud 82. The lower portion 92 of the debris reducer element 20 includes the drive seat 38 and the inner screen 40. Fluid flow past and through the debris reducer element 20 will cause the upper portion 90 to move axially and rotationally with respect to the lower portion 92. Further, axial movement of the upper portion 90 with respect to the lower portion 92 will cause the lower portion 92 to be rotated with respect to the upper portion 90 and the lower screen 64. As fluid flow acts upon the flow head 22, the debris reducer element 20 is urged axially downwardly within the lower screen 64, compressing the spring 80. The upper screen 40 and lower screen 64 will move axially with respect to each other, causing debris to be ground and reduced by this movement. In addition, the upper portion 90 of the debris reducer element 20 is moved axially downwardly with respect to the lower portion 62. During the axial downward movement, the lower ends 34 of the vanes 32 will engage the angled guide surfaces 46 of the drive seat 38, causing the drive seat 38 to rotate with respect to the drive shaft 28. As the vanes 32 move down along the angled surfaces 46, rotation of the drive seat 38 and inner screen 40 will occur, as illustrated by arrow 94 in FIG. 8, in response to axial movement 96 of the upper portion 90. Eventually, the vanes 32 will enter the longitudinal grooves 48 of the drive seat 38 at which point rotation of the upper portion 90 with respect to the lower portion 92 ends. As fluid flow along the flowline 14 to the filter 16 is reduced, the upper portion 90 of the debris reducer element 20 will be urged upwardly to its first, upper position by the spring 80. As this occurs, the vanes 32 of the drive shaft 28 will be moved upwardly out of the longitudinal grooves 48 and above the angled surfaces 46. Repeated upward and downward axial movement 96 of the upper portion 90, resulting from variations in the flow of fluid through the flow line 14, will continue to rotate the lower portion 62 within the lower screen 64. As this rotation occurs, debris will be ground between the upper screen cage 56 of the upper screen 40 and the lower screen cage 74 of the lower screen 64. Relative motion of the cutting edges 60 and the openings 62, 78 in the screen cages 56, 74 will further help to grind, cut and reduce any debris within the lower screen 64.

Figure 10:
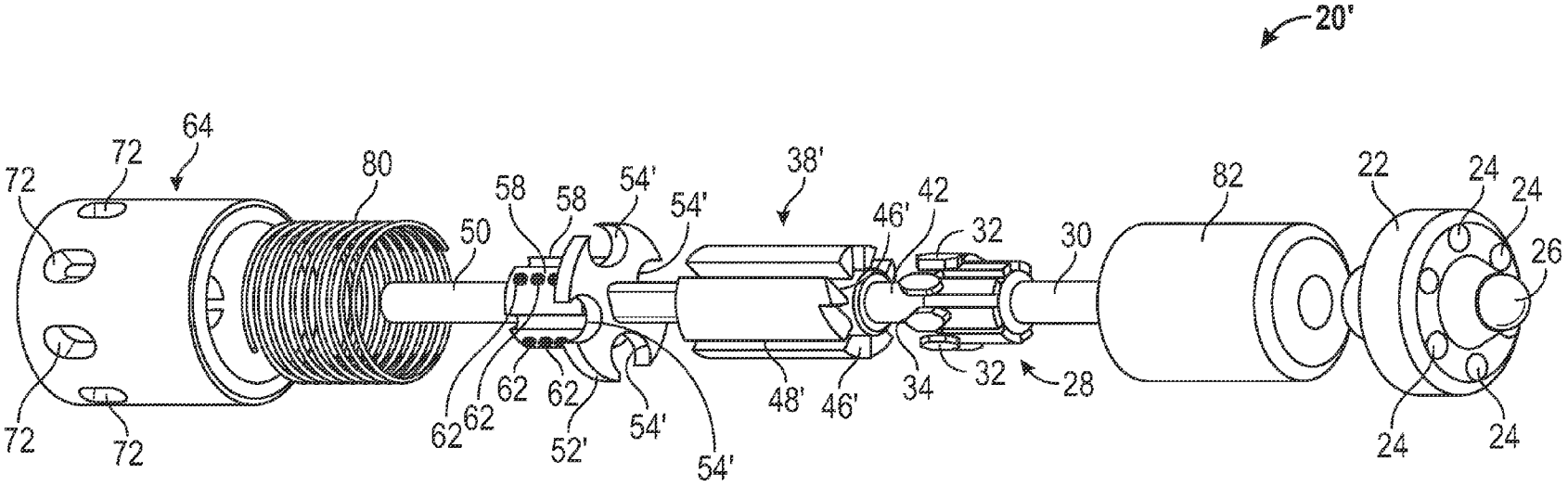
FIG. 10 is an exploded isometric view of an alternative debris reducer constructed in accordance with the present invention.
Figure 11:
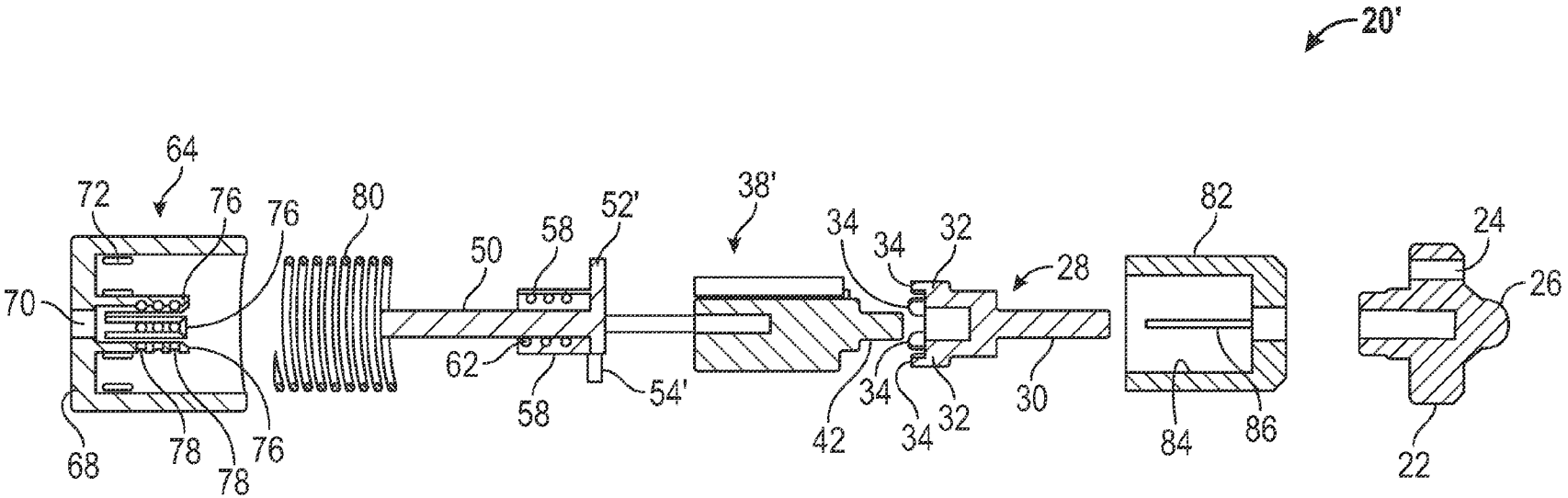
FIG. 11 is a side, cross-sectional view of the debris reducer shown in FIG. 10.

FIGS. 10 and 11 illustrate an alternative embodiment for a debris reducer 20' which has been constructed in accordance with the present invention. The debris reducer element 20' is similar to the debris reducer element 20 described earlier in most respects. It is noted that the apertures 54' disposed through the plate 52' are larger than the apertures 54 of the debris reducer 16 and each presents a gap in the outer circumference of the plate 52'. In addition, the angled guide surfaces 46' are inclined at a greater angle with respect to the longitudinal axis of the drive seat 38'. The longitudinal grooves 48' are longer to extend essentially along the entire length of the drive seat 38'.

In operation, chemical injection fluid, which may contain debris, is pumped from the surface down through the flowline 14 toward the chemical injector 12. The fluid enters the debris reducer 16, flows through the axial passages 24 of the flow head 22 and the apertures 54 of the circular plate 52 (see FIG. 6), thereby entering the lower screen 64. Debris within the chemical injection fluid is reduced within the lower screen 64 by virtue of the axial and rotational motion described above. The chemical injection fluid is then flowed out of the lower screen 64 via flow ports 72 and toward the chemical injector 12.

The debris reducer 16 is self-cleaning because the rotational and axial motion of the upper and lower screen cages 56, 74 will reduce and grind away debris within the fluid passing through the debris reducer 16 to permit it to flow out of the debris reducer 16. The debris reducer 16 is dynamic since the upper and lower portions 90, 92 of the debris reducer element 20 are moveable with respect to each other during operation, both axially and rotationally. It should be understood that the drive seat 38 with its associated angled guide surfaces 46 and grooves 48, together with the drive shaft 28 and vanes 32, and the shroud 82 collectively provide a mechanism to move the upper screen 40 axially and rotationally with respect to the lower screen 64.

Those of skill in the art will recognize that numerous modifications and changes may be made to the exemplary designs and embodiments described herein and that the invention is limited only by the claims that follow and any equivalents thereof.

What is claimed is:

1. A debris reducer for reducing debris within a fluid flow line, the debris reducer comprising:

a lower screen that is secured with respect to the flow line, the lower screen having a lower screen cage with a lower cutting portion;

a debris reducer element within the flow line and that is moveably disposed with respect to the lower screen, the debris reducer element having an upper screen cage having an upper cutting portion; and wherein the upper screen cage and the lower screen cage overlap coaxially and the upper and lower cutting portions are moved with respect to each other by fluid flow to reduce debris within fluid flowing through the flow line.

2. The debris reducer of claim 1 wherein the debris reducer element comprises:

an upper portion; and a lower portion that is moveable with respect to the upper portion, the lower portion carrying the upper screen cage.

3. The debris reducer of claim 2 wherein axial movement of the upper portion with respect to the lower portion causes the lower portion to rotate with respect to the upper portion.

4. The debris reducer of claim 2 wherein the upper portion further comprises:

a radially enlarged flow head having an opening for fluid to flow through; and a radially reduced drive shaft having a radially extending vane.

5. The debris reducer of claim 4 wherein the lower portion further comprises:

a drive seat that presents an angled guide surface; and wherein the vane of the drive shaft moves upon the angled guide surface to cause the lower portion of the debris reducer element to rotate with respect to the upper portion.

6. The debris reducer of claim 2 wherein:

the upper portion includes a drive shaft having at least one vane presenting a tapered lower end that projects axially downwardly from the drive shaft;

the lower portion includes a drive seat having an outer radial surface with at least one angled guide surface projecting radially outwardly from the drive seat; and wherein axial movement of the upper portion downwardly with respect to the lower portion will cause the lower end of the vane to travel along the guide surface and rotate the lower portion with respect to the upper portion.

7. The debris reducer of claim 6 further comprising a compressible spring that biases the lower portion toward the upper portion.

8. A debris reducer for reducing debris within a fluid flow line, the debris reducer comprising:

an outer housing that is integrated into the flow line;

a lower screen that is secured within the outer housing and having:

a cylindrical screen cage barrel having a lateral flow port disposed therethrough;

a lower screen cage located radially within the barrel and that is formed of a plurality of arcuate screen cage segments each having a cutting portion;

an upper screen cage that is moveably disposed within the outer housing having a cutting portion that lies radially outside of the lower screen cage to cause debris to be reduced as the upper screen cage is moved axially and radially with respect to the lower screen.

9. The debris reducer of claim 8 wherein the upper screen cage comprises a plurality of arcuate cage segments, each having a cutting portion.

10. The debris reducer of claim 8 further comprising a mechanism for axially and rotationally moving the upper screen cage with respect to the lower screen cage as fluid is flowed through the outer housing.

11. The debris reducer of claim 10 wherein the mechanism for axially and rotationally moving the upper screen cage comprises:

a drive shaft having a radially extending vane;

a drive seat affixed to the upper screen cage, the drive seat having an angled guide surface; and wherein the vane of the drive shaft moves upon the angled guide surface to cause the drive seat and upper screen cage to rotate.

12. The debris reducer of claim 11 further comprising:

a radially enlarged flow head affixed to the drive shaft, the flow head having an enlarged diameter that approximates the interior diameter of the outer housing; and a fluid passage disposed through the flow head that allows fluid to pass through the flow head.

13. The debris reducer of claim 8 further comprising a compressible spring that biases the upper spring cage upwardly within the outer housing.

14. The debris reducer of claim 11 further comprising a shroud that radially surrounds the drive seat, the shroud having a groove to receive the vane of the drive shaft to prevent the drive shaft from rotating within the shroud.

* * * * *